US005850052A

United States Patent [19]

Gabriel

[11] Patent Number: 5,850,052

[45] Date of Patent: Dec. 15, 1998

[54] PADDED SAFETY SHIELD

[76] Inventor: Wendell Gabriel, 530 NE. 119th St., Biscayne Park, Fla. 33161

[21] Appl. No.: 879,085

[22] Filed: Jun. 19, 1997

[51] Int. Cl.[6] ..... F41H 5/08

[52] U.S. Cl. ..... 89/36.05; 89/36.02; 89/109; 109/49.5; 2/2.5

[58] Field of Search ..... 89/36.05, 36.07, 89/36.02; 109/49.5; 2/2.5, 464

[56] References Cited

U.S. PATENT DOCUMENTS

| | | | |
|---|---|---|---|
| 1,250,197 | 12/1917 | Louppe | 2/2.5 |
| 2,020,702 | 11/1935 | Russell . | |
| 2,316,055 | 4/1943 | Davey . | |
| 3,370,302 | 2/1968 | Karlyn | 2/2.5 |
| 3,476,107 | 11/1969 | Matt, Jr. et al. | 128/133 |
| 3,841,630 | 10/1974 | Renna | 109/49.5 |
| 4,373,211 | 2/1983 | Goudreau et al. | 2/2 |
| 4,412,495 | 11/1983 | Sankar | 109/49.5 |
| 4,674,394 | 6/1987 | Martino | 89/36.05 |
| 4,919,037 | 4/1990 | Mitchell | 89/36.05 |
| 5,241,703 | 9/1993 | Roberts et al. | 2/2.5 |
| 5,273,607 | 12/1993 | O'Scanlon | 89/36.05 |
| 5,377,577 | 1/1995 | Bounkong et al. | 89/36.05 |
| 5,392,686 | 2/1995 | Sankar | 89/36.05 |
| 5,564,122 | 10/1996 | Wagner | 2/16 |

FOREIGN PATENT DOCUMENTS

| | | | |
|---|---|---|---|
| 3217949 | 11/1983 | Germany | 89/36.5 |
| 2122732 | 1/1984 | United Kingdom | 89/36.05 |

*Primary Examiner*—Stephen M. Johnson
*Attorney, Agent, or Firm*—Richard C. Litman

[57] ABSTRACT

A padded safety shield provides protection during a physical confrontation to both a user of the shield and also to the person to be subdued. The padded safety shield comprises a shield core, a padding layer disposed upon the exterior shield core surface, a protective layer of durable fabric covering the padding layer, hand grips affixed to the interior shield core surface, and a shatterproof window for protected viewing therethrough. Preferably, the exterior of the padded safety shield is contoured in the design of a turtle.

9 Claims, 3 Drawing Sheets

PADDED SAFETY SHIELD

BACKGROUND OF THE INVENTION

1. Field of the Invention

The present invention relates to personal safety devices, more particularly, to a padded safety shield for use in subdual and control of individuals while providing protection against bodily injury to both the user and the person being subdued.

2. Description of Related Art

In public safety and institutional situations it is frequently necessary to subdue and control unruly, rebellious or violent individuals. It is, of course, highly desirable to do so while limiting exposure of the custodian, guard or officer to possible risks of bodily injury from hurled objects, knives, clubs, manual blows and the like. Various shields are known to be able to effect such control while providing maximum body protection for the user. Examples of devices generally related to this art include U.S. Pat. No. 2,020,702 issued November 1935 to Russell (Protective Shield); U.S. Pat. No. 2,316,055 issued April 1943 to Davey (Shield); U.S. Pat. No. 3,370,302 issued February 1968 to Karlyn (Protective Shield Assembly); U.S. Pat. No. 3,476,107 issued November 1969 to Matt, Jr., et al. (Immobilization Shield); U.S. Pat. No. 4,412,495 issued November 1983 to Sankar (Total Body Protective Shield); U.S. Pat. No. 5,241,703 issued September 1993 to Roberts et al. (Protective Shield with a Forearm Support); U.S. Pat. No. 5,273,607 issued December 1993 to O'Scanlon (Process for Manufacturing an Heraldic Escutcheon); U.S. Pat. No. 5,377,577 issued January 1995 to Bounkong et al. (Ballistic Shield); U.S. Pat. No. 5,392,686 issued February 1995 to Sankar (Telescopic Total Body Protective Shield); and, U.S. Pat. No. 5,564,122 issued October 1996 to Wagner (Hockey Goaltender's Blocker with Angled Upper Area).

Such known devices suffer one major drawback. While those intended to protect the user and effect control do so to varying degrees, none of these shield designs account for the safety of the person being subdued. As such, a significant likelihood exists that the person being subdued will suffer an injury in the course of the confrontation. While little concern may be warranted for the safety of dangerous felons, many situations arise in which the safety of the subdued person is important. For example, a high concern for the safety of both parties usually exists in situations which arise at psychiatric facilities, substance abuse facilities, juvenile detention centers, public schools and other high-risk settings. Therefore, a need exists for a padded safety shield which protects both parties involved in physical confrontations from physical injury. None of the above inventions and patents, taken either singly or in combination, is seen to describe the instant invention as claimed.

SUMMARY OF THE INVENTION

In view of the foregoing disadvantage inherent in the known types of safety shields now present in the prior art, the present invention provides an improved padded safety shield. To attain this objective, the present invention essentially comprises a conventional safety shield, or shield core. The shield core additionally possesses a layer of padding disposed upon the exterior shield core surface.

The shield core is sized large enough to provide full-body protection to a user, and preferably, should have rounded corners to minimize the possibility that either party will be injured by a sharp corner. The shield core may be constructed of polycarbonate, plastic or any other lightweight material which is sufficiently sturdy to withstand the impact of blows or hurled objects, such as chairs or telephones, directed thereagainst. Preferably, the shield should be configured in a concave-convex transverse profile to provide the user a wider angle of protection and to better deflect the hurled objects.

The padding layer is of a thickness which is sufficient to minimize the risk of injury to the person being subdued during a physical confrontation. Preferably, the padding is covered by an outer layer of durable fabric to protect the padding and minimize the risk of tears or other damage thereto. The padding layer may be constructed of various sponge, foam or other conventional cushioning materials. Further, the exterior surface of the padded shield may be contoured in the design of an aesthetically pleasing design, such as a turtle shell, to reduce the perceived threat to, and anxiety of, the person being subdued.

Other features include a viewing hole or shatter-proof window disposed within the padded shield to enable a shielded user to see the attacker. Also, suitable hand grips, affixed to the interior surface of the protective shield, enable the user to lift and position the shield. The hand grips may be designed for two-handed carriage, or alternatively, one-handed, forearm-slinged carriage to free the user's other hand. Preferably, the hand grips are fabricated from lightweight metals such as aluminum or rugged plastics such as polycarbonate. They may be affixed to the interior shield core surface by any suitable means such as threaded fasteners, rivets or adhesives. Optionally, the interior surface of the shield core may also be padded to provide extra protection to a user of the shield.

The padded safety shield also has additional uses. It may be used by law enforcement and military organizations for combat training sessions. The padded safety shield is also useful for martial arts practice sessions and various sporting activities.

Accordingly, it is a principal object of the invention to provide a padded safety shield which protects both the user and the attacker from injury while the attacker is being subdued.

It is another object of the invention to provide a padded safety shield with rounded edges to preclude injuries from sharp corners.

It is a further object of the invention to construct the padded safety shield in the form of an aesthetically pleasing design such as a turtle shell to reduce the anxiety of the person to be subdued.

It is an object of the invention to provide improved elements and arrangements thereof in an apparatus for the purposes described which is inexpensive, dependable and fully effective in accomplishing its intended purposes. These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
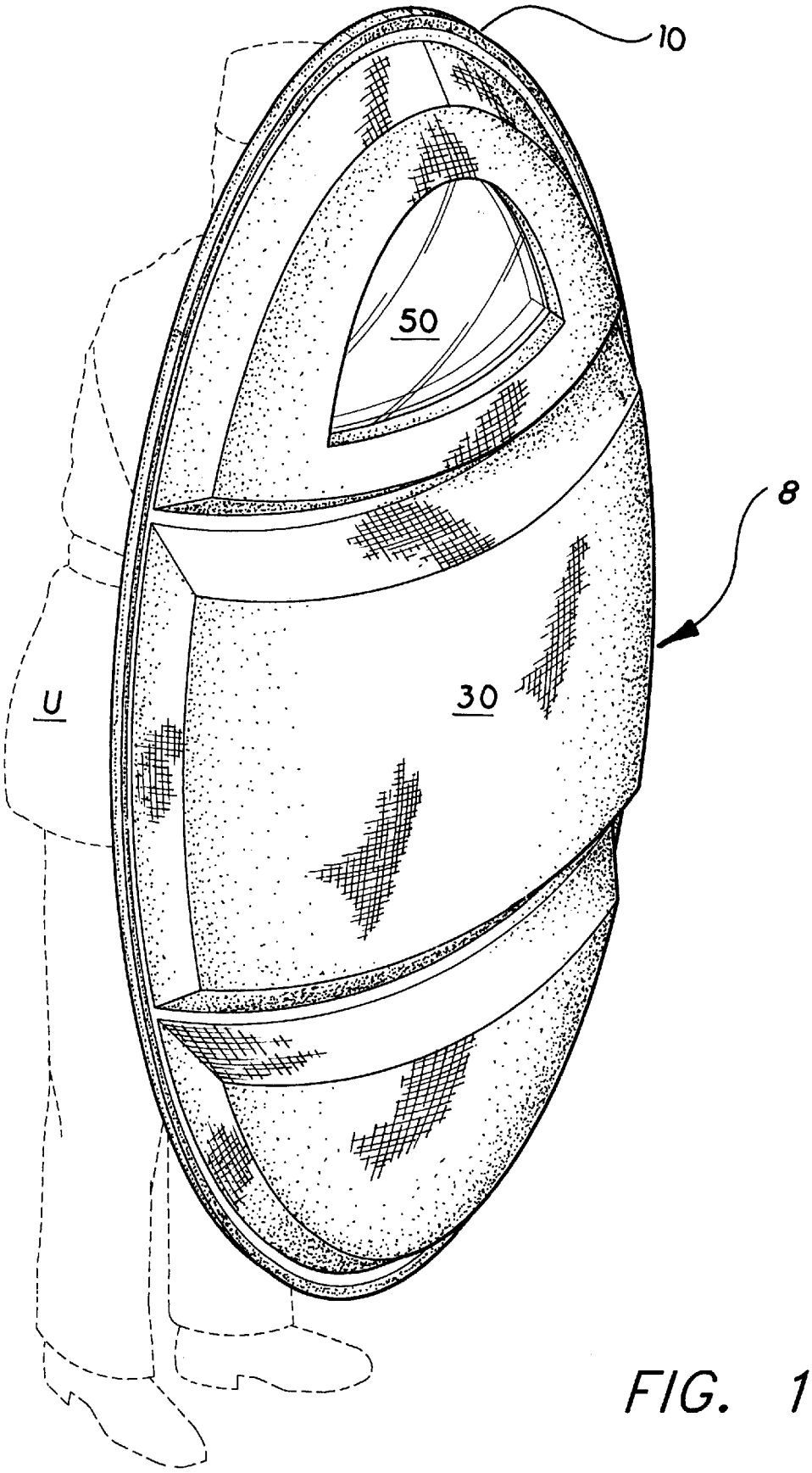
FIG. 1 is an environmental, perspective view of the padded safety shield held by a user.

As depicted by FIG. 1 through FIG. 4, the padded safety shield 8 comprises the following elements. A shield core 10 has an interior shield core surface 11 and an exterior shield core surface 19. The shield core may be constructed of aluminum, polycarbonate, plastic or any other substantially rigid, lightweight material, which is sufficiently sturdy for withstanding the impact of blows or hurled objects directed thereagainst. It is highly preferable that the padded safety shield be of a size large enough to provide full-body protection to a user U. A padding layer 20 has an interior padding layer surface 21 in contact with the exterior shield core surface 19 of the shield core 10, and an exterior padding layer surface 29 opposite the interior padding layer surface 21. The padding layer 20 is of a thickness sufficient to minimize the risk of injury to a person being subdued during a physical confrontation. A layer of durable fabric 30 covers the exterior padding layer surface 29 to protect the padding layer 20 and minimize the risk of tears or other damage thereto. Such fabric may be a tightly woven nylon, polyester or neoprene fabric.

Figure 2:
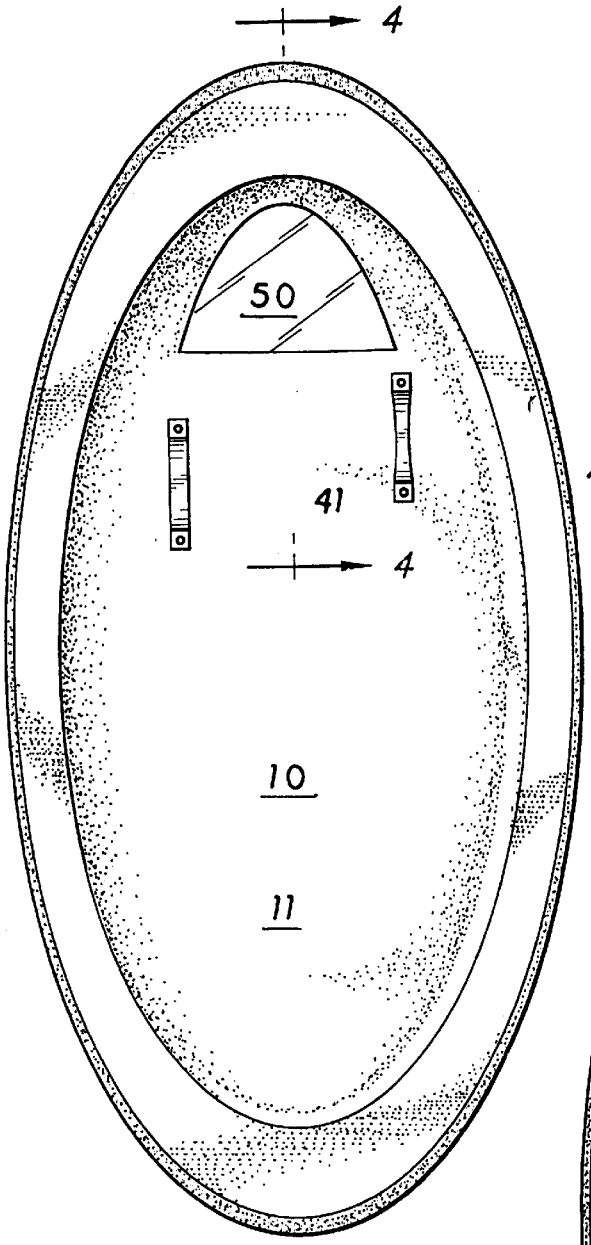
FIG. 2 is a rear view of the padded safety shield, depicting an embodiment for two-handed holding.
Figure 3:
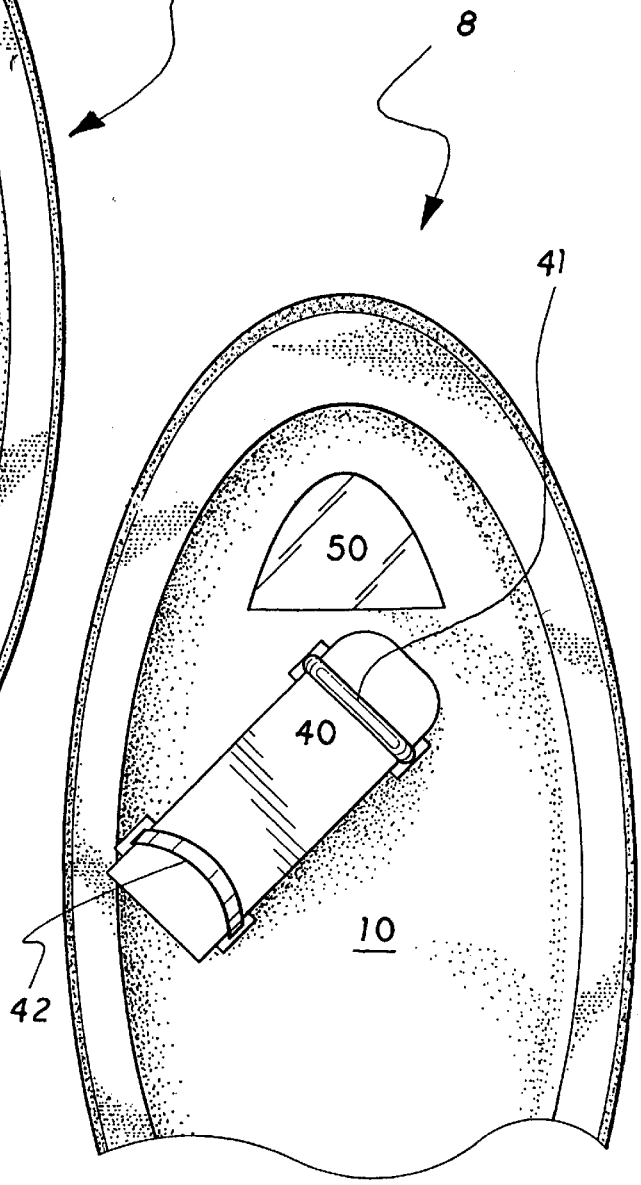
FIG. 3 is a rear view of the padded safety shield, depicting an alternate embodiment for one-handed holding.
Figure 4:
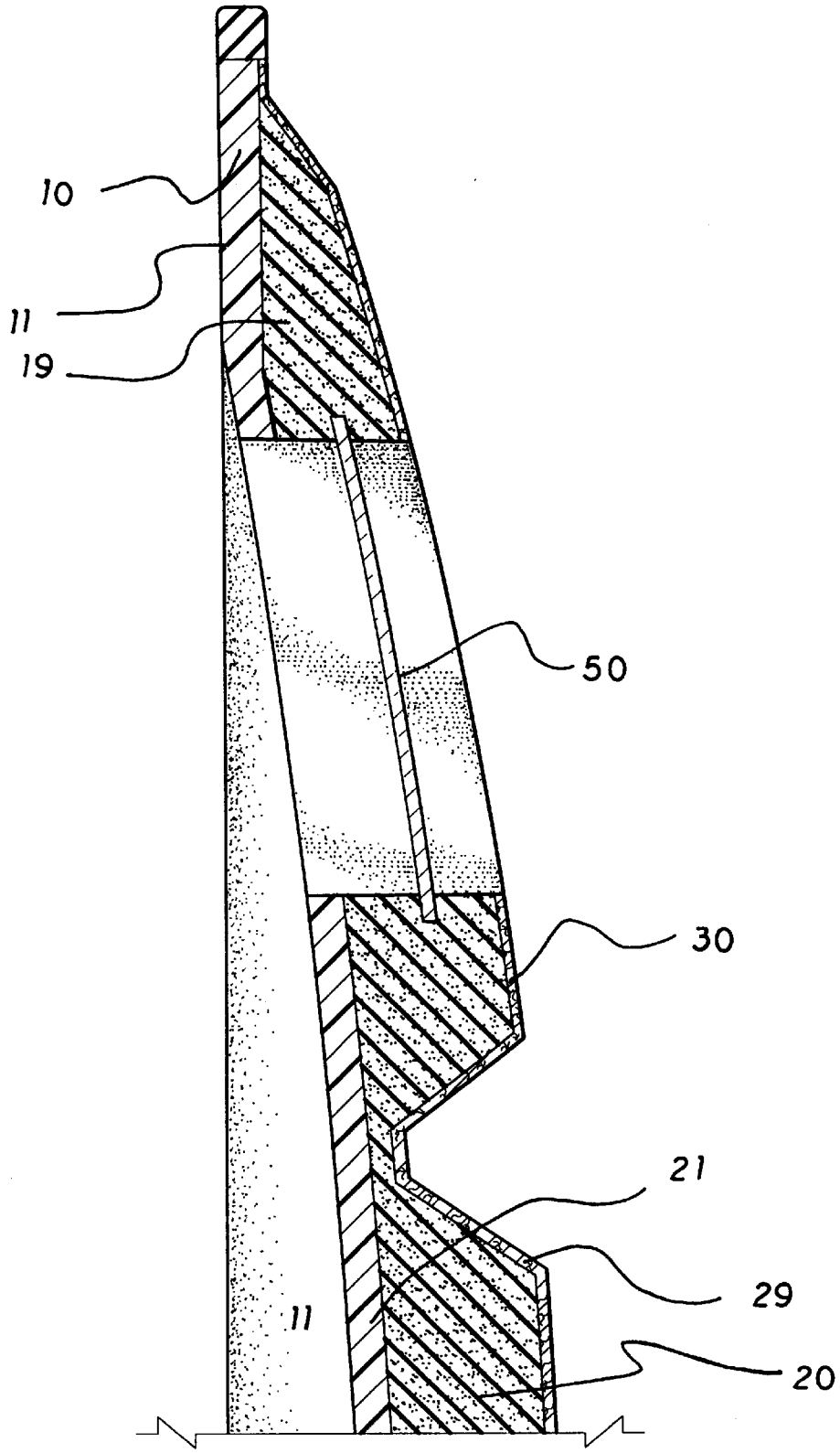
FIG. 4 is a cross-section view drawn along line 4—4 of FIG. 2 depicting the layers of the padded safety shield.

The figures further depict a shatter-proof window 50 disposed within the padded safety shield 8 to enable a user U to see an attacker from behind the padded safety shield 8 while positioned behind the shield. A holding means 40 is affixed to the interior shield core surface for enabling the user to lift and position the shield as necessary for protection and viewing. FIG. 2 depicts one embodiment of the holding means 40. In this embodiment, the holding means 40 comprises two hand grips 41 affixed to the interior shield core surface 11. FIG. 3 depicts an alternate embodiment of the holding means 40. In the alternate embodiment, the holding means 40 comprises a forearm sling 42 affixed to the interior shield core surface 11, and a hand grip 41 affixed to the interior shield core surface 11 in alignment with the forearm sling 42. The combination of forearm sling 42 and hand grip 41 enable a user U to hold the padded safety shield 8 with one hand, thereby leaving the user's U other hand free.

It is to be understood that the present invention is not limited to the sole embodiment described above, but encompasses any and all embodiments within the scope of the following claims.

I claim:

1. A padded safety shield, comprising:

a shield core having an interior shield core surface and an exterior shield core surface, the shield core constructed of substantially rigid, lightweight material for withstanding a predetermined impact force thereagainst;

a padding layer disposed on the exterior shield core surface, the padding layer having an interior padding layer surface in contact with the exterior shield core surface, an exterior padding layer surface opposite the interior padding layer surface, said exterior padding layer surface being contoured to simulate a shape of a turtle shell, and the padding layer being of a predetermined thickness to minimize risk of injury to a person being subdued during a physical confrontation;

a layer of durable fabric covering the exterior padding layer surface for protecting said padding layer, said layer of durable fabric being colored to simulate a turtle shell;

a holding means affixed to the interior core shield surface for enabling a user to lift and position the shield.

2. The padded safety shield according to claim 1, wherein the shield core is constructed of a material selected from the group consisting of aluminum, polycarbonate and plastic.

3. The padded safety shield according to claim 1, wherein the padded safety shield is dimensioned and configured to extend substantially the full length of the body of the user.

4. The padded safety shield according to claim 1, wherein the padded safety shield is configured to have a concave-convex transverse profile wherein said interior shield core surface is substantially concave and said exterior shield core surface is substantially convex.

5. The padded safety shield according to claim 1, wherein the padded safety shield has rounded corners.

6. The padded safety shield according to claim 1, wherein the holding means comprises at least one hand grip affixed to the interior core shield surface.

7. The padded safety shield according to claim 1, wherein the holding means further comprises:

a forearm sling affixed to the interior core shield surface;

at least one hand grip affixed to the interior core shield surface in alignment with the forearm sling; and wherein the forearm sling and the hand grip, in combination, enable one-handed use by the user.

8. The padded safety shield according to claim 1, further comprising a viewing hole disposed within the padded safety shield for enabling the user to view through the padded safety shield.

9. The padded safety shield according to claim 1, further comprising a shatter-proof window disposed within the padded safety shield to enable the user to see an attacker from behind the padded safety shield.

* * * * *